US005168257A

United States Patent [19]

Frielinghaus

[11] Patent Number: 5,168,257

[45] Date of Patent: Dec. 1, 1992

[54] FOUR TERMINAL SAFETY RESISTOR

[76] Inventor: Klaus H. Frielinghaus, 167 Shalimar Dr., Rochester, N.Y. 14618

[21] Appl. No.: 601,953

[22] Filed: Oct. 23, 1990

[51] Int. Cl.[5] ..... H01C 1/14

[52] U.S. Cl. ..... 338/322; 338/325

[58] Field of Search ..... 338/322, 325

[56] References Cited

U.S. PATENT DOCUMENTS 3,959,763 5/1976 Sibley et al. ..... 338/325 X 4,355,293 10/1982 Driscoll ..... 338/184

*Primary Examiner*—Marvin M. Lateef

*Attorney, Agent, or Firm*—Robert S. Smith

[57] ABSTRACT

A 4-terminal resistor apparatus which includes a body of resistive material having opposed first and second ends and opposite first and second sides. The distance between the opposed ends is no greater than the distance minimum width of the body intermediate opposed ends. Preferably, the width is 3 or 4 times greater than the distance intermediate the opposed ends. The first and second ends have respective first and second metal contact surfaces disposed thereon. The first and second pairs of leads each include first and second leads, each pair of leads engages one of the metal contact surfaces. The apparatus also includes means for holding the leads in each of the pairs of leads apart even if one of the leads in a given pair should become detached from the body of resistive material. In many forms of the invention the body is disc shaped.

24 Claims, 2 Drawing Sheets

FOUR TERMINAL SAFETY RESISTOR

BACKGROUND OF THE INVENTION

The invention relates to resistors for electronic and electrical circuits and particularly to a four terminal safety resistor. The invention has particular application to certain fail safe circuits. One type of fail safe circuit is, for example, found in railway signalling circuits. In the event of failure such circuits must fail in a manner that will cause the train or other control system to default to a more restrictive operating mode. For example, in the case of a train control system this is necessary to prevent the possibility of an accident.

For the design of various equipment it is desirable to have a compact 4-terminal safety resistor, which can be mounted on printed circuit boards. The prior art includes conventional two terminal resistors of the "established reliability" type that have passed government lead integrity tests. These resistors are mounted in such a manner that two independent connections are made to each of the two leads. Such devices have been installed in emitter voltage divider circuits and other circuits which demand fail-safe performance characteristics. Such arrangements required a substantial area on a printed circuit board, were expensive to manufacture, and required special handling.

The prior art also includes several four terminal electrical components. These include a four terminal varistor described in U.S. Pat. No. 3,959,763. This patent, having the same assignee as the present application, describes a structure which, in one form, utilizes conventional semiconductor material which have contact metalization on opposite sides of the material. Two discreet leads extend from each of the contact metalization areas.

U.S. Pat. No. Re. 29,126 based on U.S. Pat. No. 3,792,323 describes a wound capacitor that has four discrete leads. U.S. Pat. No. 4,614,906 discloses a means for connecting a plurality of loads in series across a voltage source without encountering reliability problems due to failure of any portion of the series circuit. U.S. Pat. No. 3,614,466 discloses a method for using a photopositive resistive element in an amplifier circuit such that the circuit will not produce an output during a component failure in a feedback loop. U.S. Pat. No. 4,528,610 discloses a means for isolating a section of a circuit from a supply in the event of a short circuit in the section.

These prior art devices and circuits do not satisfy the requirements for various circuits such as the emitter terminal voltage divider of a safety critical circuit.

It is an object of the invention to provide a compact 4-terminal resistor.

It is an object of the invention to provide a 4-terminal resistor that, in the event of a rare failure, has a failure mode that causes a default of the control circuit of which it is a part to a more restrictive manner of operation.

It is an object of the invention to provide a 4-terminal resistor which is inexpensive to manufacture.

Still another object of the invention is to provide a 4-terminal resistor which is particularly adapted for mounting on a printed circuit board.

SUMMARY OF THE INVENTION

It has now been found that these and other objects of the invention may be attained in a 4-terminal resistor apparatus which includes a body of resistive material having opposed first and second ends. The distance between the opposed ends is no greater than the minimum width of the body intermediate the opposed ends. The opposed first and second ends have respective first and second metal contact surfaces disposed thereon. The first and second pairs of leads each include first and second leads, each pair of leads engages one of the metal contact surfaces. The apparatus also includes means for holding the leads in each of the pairs of leads apart even if one of the leads should become detached from the resistive material body.

In many forms of the invention the minimum width intermediate the opposed ends is 3 or 4 times greater than the distance between the opposed ends. In many forms of the invention the body is disc or washer shaped and the ends may be generally circular in form. Thus, the diameter in some forms of the invention is 3 or 4 times the distance between the opposed ends of the body.

The means for holding may include first and second caps extending respectively over the first and second ends of the body. The means for holding may include at least one bend in each of the leads. The leads may each have a bend that is a right angle bend and in some cases may have a second right angle bend.

Each of the leads may include a curvilinear axial portion in contact with the metal contact surfaces. Each of the curvilinear axial portions in each lead may be disposed intermediate the first and second right angle bends in that lead. The first and second right angle bends may be proximate to the axial extremities of the curvilinear axial portions in each of the leads. In some forms of the invention the curvilinear axial portion on each lead is generally arcuate.

BRIEF DESCRIPTION OF THE DRAWING

The invention will be better understood by reference to the accompanying drawing in which.

DESCRIPTION OF THE PREFERRED EMBODIMENT

Figure 1:
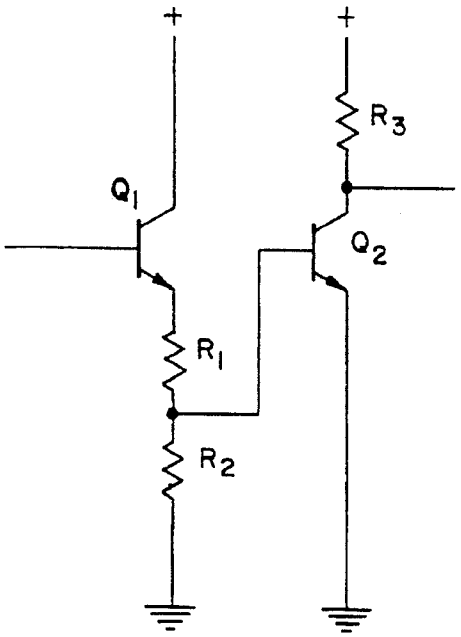
FIG. 1 is a schematic view of a typical safety type circuit.

Referring now to FIG. 1 there is shown a schematic of a typical circuit where safety is involved. An input is fed to the base of a transistor Q1 having the emitter coupled to the base of a transistor Q2. A voltage divider is used in the emitter circuit of the transistor Q1. If the signal level at the base of a transistor Q2 is sufficiently high, a "go" signal is generated at the collector of the transistor Q2. Since a voltage divider is required in the emitter circuit of the transistor QI, any component failure in the circuit of transistor QI and/or its voltage divider, would cause a higher signal level to appear at the base of the transistor Q2. This would create an unsafe condition by generating a "go" signal when the actual input signal was not of sufficient amplitude to normally create a valid "go" signal.

The conventional film resistor RI is constructed in a manner that does not have a failure mode which would cause the resistance value thereof to reduce upon failure. Unfortunately, if the resistor R2 either became an open circuit, or a lead connection to the resistor R2 opened up, the signal level at the junction of the resistor RI and the resistor R2 would increase and would falsely create a "go" signal at the collector of the transistor Q2.

Figure 2:
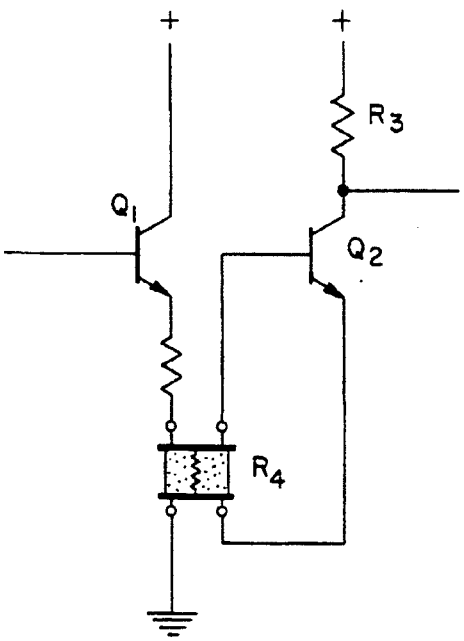
FIG. 2 is a schematic view of a similar circuit in which a 4-terminal resistor is incorporated.

The circuit illustrated in FIG. 2 illustrates the application of the 4-terminal concept to a resistor R4 which would prevent a false "go" signal from being generated if any lead to resistor R4 opened up. If any lead opens up on the resistor R4 it will either open the signal path to the base of the transistor Q2, or disconnect the common return to the transistor Q2. (It will be understood that the conventional resistor symbol has been included in the graphic representation for resistor R4 in FIG. 2.)

Figure 3:
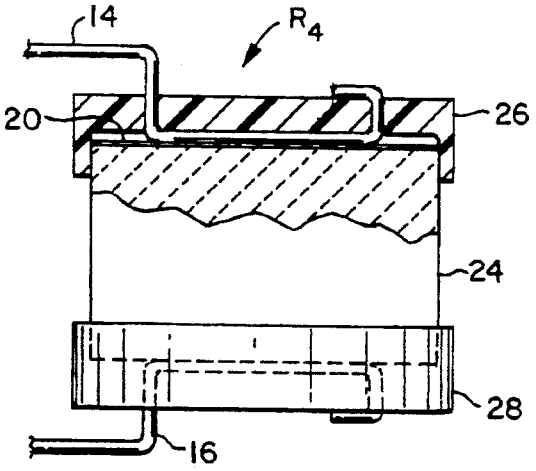
FIG. 3 is an elevational view in partial section of a 4-terminal resistor in accordance with one form of the invention.

Referring now to FIG. 3 there is shown an embodiment of the resistor R4 in accordance one form of the apparatus of the invention. The resistive element or disc 24 is a solid disc or cylinder made of ceramic or organic resistive material. Although a disc or other cylindrical form (such as washer shape) is preferred it will be understood that in other forms of the invention other geometric forms may be utilized. The resistor R4 has two leads 12, 14 connected to an upper conducting surface 20 and two leads 16, 18 connected to a similar bottom conductive surface not shown. The conducting surfaces such as the top conducting surface 20 is a metallic lead attachment surfaces that is plated or metal sprayed onto the disc shaped resistive element 24.

The leads 12, 14, 16, 18 shown in FIGS. 3–6 illustrates a preferred form which has a single piece of wire for each lead. Each lead includes an arcuate section having a radius of curvature that is somewhat less than the radius of curvature of the outer wall of the disc 24.

Referring particularly now to FIG. 3, there is shown a button like insulating cap 26 which holds the two leads 12, 14 apart even if one of the leads should become detached from the conducting surface 20 of the disc shaped resistance element 24. The cap 26 may be plastic in some embodiments of the invention. Similarly, a cap 28 is disposed on the bottom or lower axial extremity of the resistor R4. The cap 28 functions to hold the leads 16, 18 apart even if they should become detached from the element 24.

It will be understood that in one form of the invention the height of the element 24 will be less than or equal to the diameter of the element 24. In the preferred form of the invention the minimum width or diameter or diameter of the element 24 is 3 or 4 times greater than the height of the element 24. This dimensional relationship is important to insure that a horizontal fracture mode would be extremely unlikely. (It will be understood that other geometric forms, other than cylinders, may be utilized and that the terms height and width are appropriate to describe the invention broadly. In other words, the terms height and diameter are appropriate for the preferred form of the invention but not the broadest form of the invention.)

Figure 5:
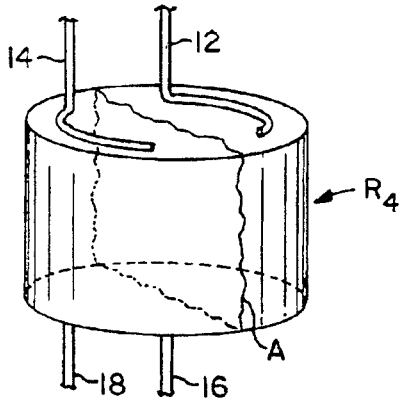
FIG. 5 is a fragmentary perspective view of a resistor in accordance with one form of the invention including a partially schematic representation of a generally vertical fracture plane.
Figure 6:
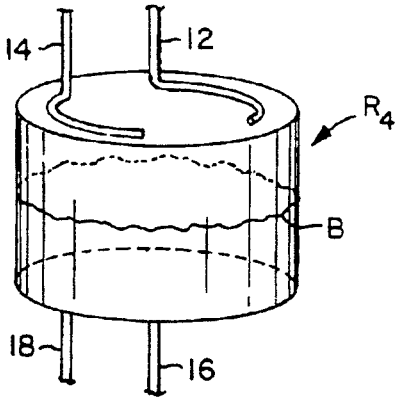
FIG. 6 is a fragmentary perspective view similar to that of FIG. 5 including a partially schematic representation of a generally horizontal fracture plane.

More specifically, FIGS. 5 and 6 illustrate two fracture possibilities of the disc shaped resistance element 24. Fracture A is a possible fracture mode that would result in the raising of the resistance of the resistance element, but it would be safe, since it would disrupt the electrical continuity between the double wire leads at each end of the resistance element 24. Fracture B, while not a safe electrical detectable fracture, would be highly unlikely fracture due to the low height to diameter configuration of the disc shaped resistive element 24. While there is a possibility of minor vertical fractures around the periphery of the disc shaped resistive element 24, the cap 26 will minimize this occurrence.

The resistor R4 in accordance with the described and preferred form of the invention when installed, for example, in the circuit of FIG. 2 provides fail safe operation upon fracture (1) along the axis of the disc, leaving one lead on either side of both fragments) or (2) upon the opening of a resistor lead.

Figure 4:
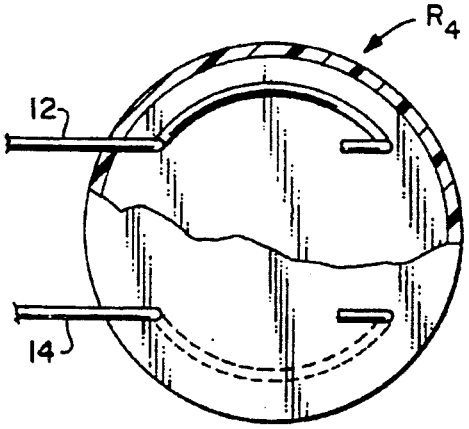
FIG. 4 is a plan view of the 4-terminal resistor shown in FIG. 3.

Each conducting surface 20 (one shown) on the element 24 has attached to it two conductive leads. More specifically, as shown in FIG. 4 the leads 12, 14 engage one conducting surface 20 and the leads 16, 18 engage another conducting surface 20. The form of the leads 12, 14 includes bends such as 14A and 14B to insure there engagement with the cap 26 even if the cap 26 is disengaged from the element 24. These bends 14A, 14B have a portion extending at an angle of 90 degrees to the conducting surface 20 and protruding through a button-like insulating cap 26 that covers the conducting surface 20. This engagement with the cap 26 keeps the leads 12, 14 separated from each other whether the cap 26 remains secured to the element 24 or if it becomes detached from the element. As best seen in FIG. 4 the leads 12, 14 include curvilinear portions 12C and 14C to further enhance the engagement with the cap 26.

It will be understood that the views of FIGS. 5 and 6 show the leads 12, 14, 16, 18 in a fragmentary representation for simplicity.

The invention provides a true 4-terminal resistor, which is inexpensive, does not require special handling, and uses very little space on a printed circuit board.

The invention has been described with reference to its illustrated preferred embodiment. Persons skilled in the art of such devices may upon exposure to the teachings herein, conceive other variations and other safety circuit applications for the apparatus in accordance with the invention. Such variations are deemed to be encompassed by the disclosure, the invention being delimited only by the following claims.

Having thus described my invention I claim:

1. A 4-terminal resistor apparatus which comprises:

a body of resistive material, said body having opposed first and second ends, the distance between said opposed first and second ends being no greater than the minimum width of said body intermediate said opposed first and second ends;

said opposed first and second ends having respective first and second metal contact surfaces disposed thereon;

first and second pairs of leads, each including first and second leads, each pair of leads engaging one of said metal contact surfaces; and means for holding the leads in each of said pairs of leads apart even if one of said leads should become detached from said body.

2. The apparatus as described in claim 1 wherein:

said the minimum width of said body intermediate said opposed first and second ends is at least 3 times the distance intermediate said opposed first and second ends.

3. The apparatus as described in claim 1 wherein:
said the minimum width of said body intermediate said opposed first and second ends is at least 4 times the distance intermediate said opposed first and second ends.

4. The apparatus as described in claim 2 wherein:
said body is cylindrically shaped.

5. The apparatus as described in claim 4 wherein:
said opposed first and second ends are generally circular in form.

6. A 4-terminal resistor apparatus which comprises:
a body of resistive material, said body having opposed first and second ends, the distance between said opposed first and second ends being no greater than the minimum width of said body intermediate said opposed first and second ends;
said opposed first and second ends having respective first and second metal contact surfaces disposed thereon;
first and second pairs of leads, each including first and second leads, each pair of leads engaging one of said metal contact surfaces; and
means for holding the leads in each of said pairs of leads apart even if one of said leads should become detached from said body, said the minimum width of said body intermediate said opposed first and second ends is at least 3 times the distance intermediate said opposed first and second ends, said body being cylindrically shaped, said opposed first and second ends being generally circular in form, said means for holding includes first and second caps extending respectively over said opposed first and second ends of said body.

7. The apparatus as described in claim 6 wherein:
said means for holding includes at least one bend in each of said leads.

8. The apparatus as described in claim 7 wherein:
each of said leads includes at least one right angle bend.

9. The apparatus as described in claim 8 wherein:
each of said leads includes a second right angle bend.

10. The apparatus as described in claim 9 wherein:
each of said leads includes a curvilinear axial portion in contact with said metal contact surfaces.

11. The apparatus as described in claim 10 wherein:
each of said curvilinear axial portions in each lead is disposed intermediate said first and second right angle bends in that lead.

12. The apparatus as described in claim 11 wherein:
said first and second right angle bends are proximate to the axial extremities of said curvilinear axial portions in each of said leads.

13. The apparatus as described in claim 12 wherein:
said curvilinear axial portion on each lead is generally arcuate.

14. A 4-terminal resistor apparatus which comprises:
a body of resistive material, said body having opposed first and second ends, the distance between said opposed first and second ends being no greater than the minimum width of said body intermediate said opposed first and second ends;
said opposed first and second ends having respective first and second metal contact surfaces disposed thereon;
first and second pairs of leads, each including first and second leads, each pair of leads engaging one of said metal contact surfaces; and
means for holding the leads in each of said pairs of leads apart even if one of said leads should become detached from said body, said means including at least one bend in each of said leads.

15. The apparatus as described in claim 14 wherein:
said the minimum width of said body intermediate said first and second ends is at least 3 times the distance intermediate said opposed first and second ends.

16. The apparatus as described in claim 15 wherein:
said the minimum width of said body intermediate said opposed first and second ends is at least 4 times the distance intermediate said opposed first and second ends.

17. The apparatus as described in claim 16 wherein:
said body is cylindrically shaped.

18. The apparatus as described in claim 17 wherein:
said opposed first and second ends are generally circular in form.

19. A 4-terminal resistor apparatus which comprises:
a body of resistive material, said body having opposed first and second ends, the distance between said opposed first and second ends being no greater than the minimum width of said body intermediate said opposed first and second ends;
said opposed first and second ends having respective first and second metal contact surfaces disposed thereon;
first and second pairs of leads, each including first and second leads, each pair of leads engaging one of said metal contact surfaces; and
means for holding the leads in each of said pairs of leads apart even if one of said leads should become detached from said body, said means including at least one bend in each of said leads, said the minimum width of said body intermediate said first and second ends being at least 3 times the distance intermediate said opposed first and second ends, said body being cylindrically shaped, said opposed first and second ends are generally circular in form, said means for holding includes first and second caps extending respectively over said first and second ends of said body.

20. The apparatus as described in claim 19 wherein:
each of said bends is a right angle bend.

21. The apparatus as described in claim 20 wherein:
each of said leads includes a second right angle bend.

22. The apparatus as described in claim 21 wherein:
each of said leads includes a curvilinear axial portion in contact with said metal contact surfaces.

23. The apparatus as described in claim 22 wherein:
each of said curvilinear axial portions in each lead is disposed intermediate said first and second right angle bends in that lead.

24. The apparatus as described in claim 23 wherein:
said first and second right angle bends are proximate to the axial extremities of said curvilinear axial portions in each of said leads.

* * * * *